US006382751B1

(12) United States Patent
Chiu

(10) Patent No.: US 6,382,751 B1
(45) Date of Patent: May 7, 2002

(54) BUMPING BLOCK FOR A TRACK DEVICE OF A DESK

(75) Inventor: Chu-Hung Chiu, Kaohsiung (TW)

(73) Assignee: Win Metals Co., Ltd., Kaohsiung (TW)

( * ) Notice: Subject to any disclaimer, the term of this patent is extended or adjusted under 35 U.S.C. 154(b) by 0 days.

(21) Appl. No.: 09/791,129

(22) Filed: Feb. 22, 2001

(51) Int. Cl.[7] ..... A47B 88/00
(52) U.S. Cl. ..... 312/334.11; 312/334.46
(58) Field of Search ..... 312/334.46, 334.44, 312/333, 334.8, 334.11; 248/573, 429, 345.1, 903

(56) References Cited

U.S. PATENT DOCUMENTS 5,722,750 A * 3/1998 Chu
6,220,683 B1 * 4/2001 Chu
6,257,683 B1 * 7/2001 Yang

* cited by examiner

*Primary Examiner*—Anita King
*Assistant Examiner*—Korie Chan
(74) *Attorney, Agent, or Firm*—Alan Kamrath; Rider, Bennett, Egan & Arundel, LLP

(57) ABSTRACT

A track device is provided for a desk having a plate slidably mounted therein and includes a pair of tracks respectively fixed to two mutually facing inner walls of the desk and a pair of sliding strips securely and respectively mounted two lateral sides of the plate. A bumping block is mounted to each track and includes an end. An arcuate bumping member is provided on the end of the bumping block for impeding an end of an associated sliding strip. Two ribs project from an end face of the end of the bumping block and extend radially outward toward the arcuate bumping member, thereby presenting a V-shape configuration.

2 Claims, 5 Drawing Sheets

BUMPING BLOCK FOR A TRACK DEVICE OF A DESK

BACKGROUND OF THE INVENTION

1. Field of the Invention

The present invention relates to a bumping block for a track device of a desk, e.g., a computer desk.

2. Description of the Related Art

FIG. 5 of the drawings illustrates a conventional bumping block 14 and FIG. 6 illustrates a conventional track device 10 employing such a bumping block 14. The track device 10 includes a pair of tracks 11 respectively mounted to two mutually facing inner wall surfaces of, e.g., a computer desk. A plate (not shown) for supporting, e.g., a computer keyboard has two sliding strips 12 respectively attached to two lateral sides thereof. Each sliding strip 12 is slidably guided in an associated track 11. Each track 11 has a mounting hole 13 for receiving a mounting portion 15 of the bumping block 14. The bumping block 14 includes several protrusions 16 on an end thereof for impeding a front end 17 of the sliding strip 12. However, the bumping block 14 is made from rigid plastic material and the protrusions 16 cannot provide sufficient resilience or elastomericity for reliably and efficiently absorbing impact from the front end 17 of the sliding strip 12. As a result, the computer desk is subjected to shocks when pushing the plate into its storage position.

FIG. 7 of the drawings illustrates a conventional bumping block 24 and. FIG. 8 illustrates a conventional track device 20 employing such a bumping block 24. The track device 20 includes a pair of tracks 21 respectively mounted to two mutually facing inner wall surfaces of, e.g., a computer desk. A plate (not shown) for supporting, e.g., a computer keyboard has two sliding strips 22 respectively attached to two lateral sides thereof. Each sliding strip 22 is slidably guided in an associated track 21. Each track 21 has a mounting hole 23 for receiving a mounting portion 25 of the bumping block 24. The bumping block 24 includes an arcuate bumping member 26 on an end thereof for impeding a front end 27 of the sliding strip 22. It was, however, found that the arcuate bumping member 26 breaks easily during use.

SUMMARY OF THE INVENTION

It is the primary object of the present invention to provide an improved bumping block for a track device of a desk that improves the bumping effect and increases the structural strength.

In accordance with a preferred embodiment of the invention, a track device is provided for a desk having a plate slidably mounted therein. The track device comprises a pair of tracks respectively fixed to two mutually facing inner walls of the desk and a pair of sliding strips securely and respectively mounted two lateral sides of the plate. A bumping block is mounted to each track and includes an end. An arcuate bumping member is provided on the end of the bumping block for impeding an end of an associated sliding strip. Two ribs project from an end face of the end of the bumping block and extend radially outward toward the arcuate bumping member, thereby presenting a V-shape configuration.

Thus, the end of the sliding strip is impeded by the arcuate bumping member of the bumping block when the plate for supporting the computer keyboard is moved inward. This prevents shocks to the computer desk when pushing the plate inward to its storage position. The ribs of the bumping block improve the structural strength and prevent breakage of the arcuate bumping member.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
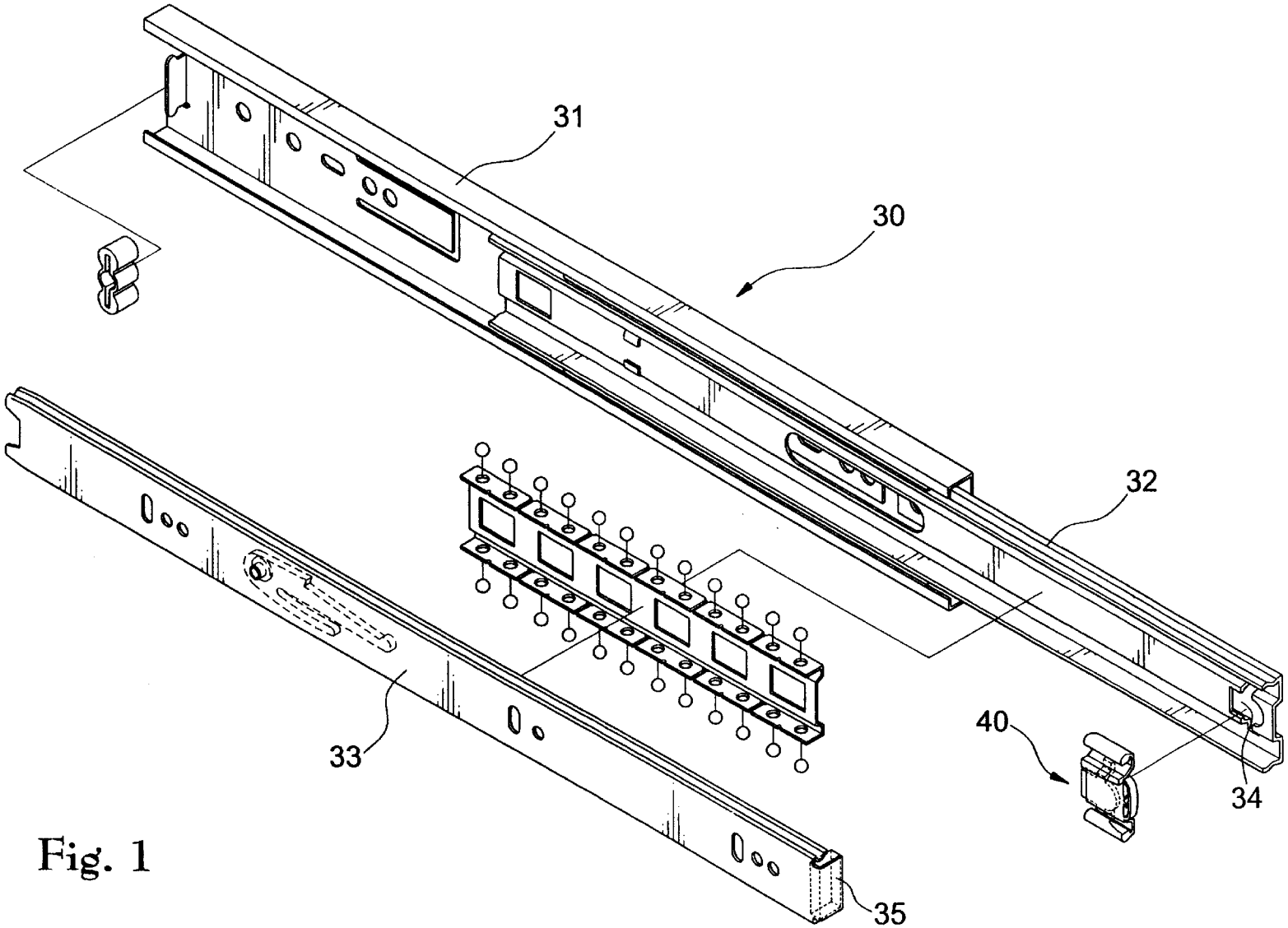
FIG. 1 is an exploded perspective view of a track device with a bumping block in accordance with the present invention.
Figure 2:
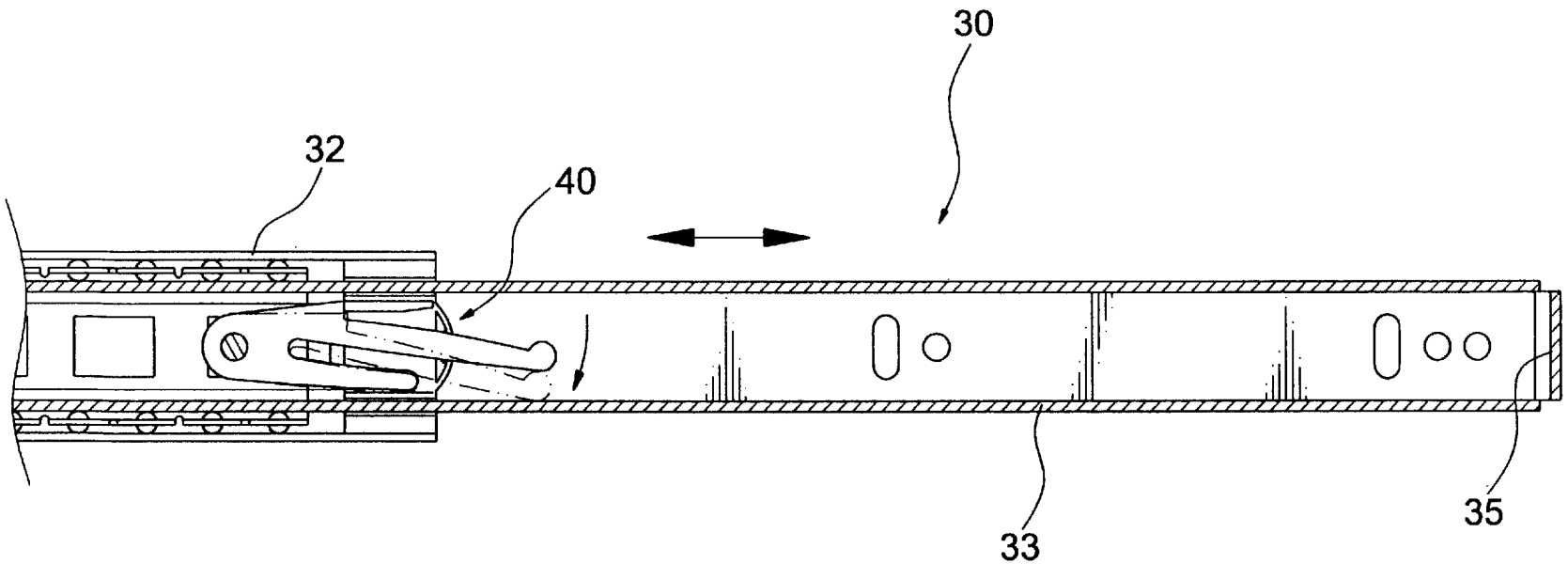
FIG. 2 is a longitudinal sectional view of the track device in FIG. 1.
Figure 3:
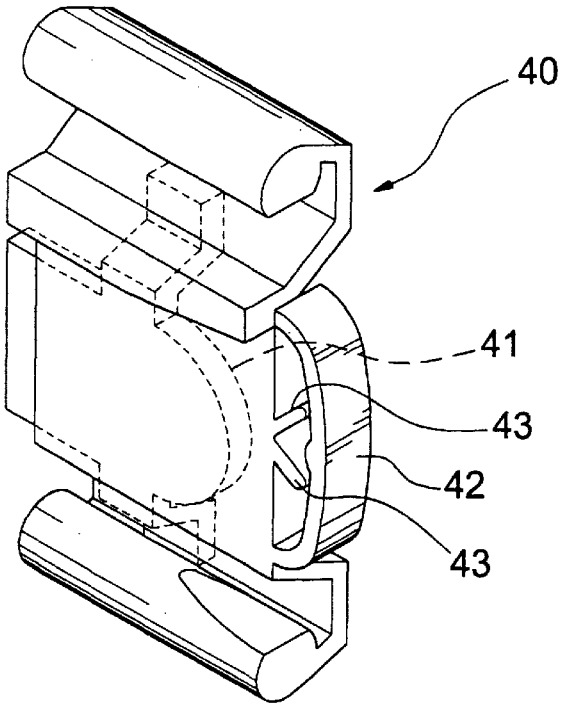
FIG. 3 is a perspective view of the bumping block in accordance with the present invention.
Figure 4:
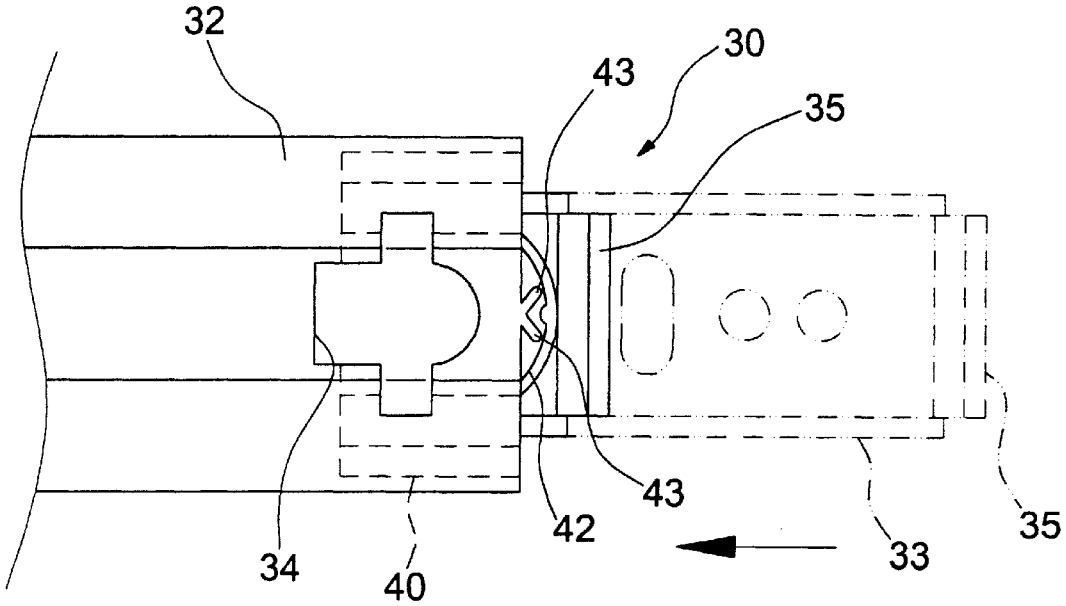
FIG. 4 is a schematic top view of a portion of the track device in FIG. 1.
Figure 5:
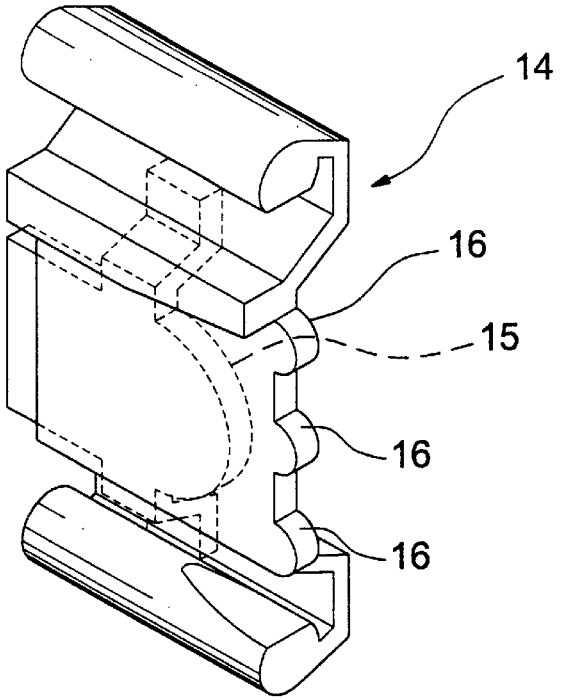
Fig. 5 PRIOR ART
FIG. 5 is a perspective view of a conventional bumping block.
Figure 6:
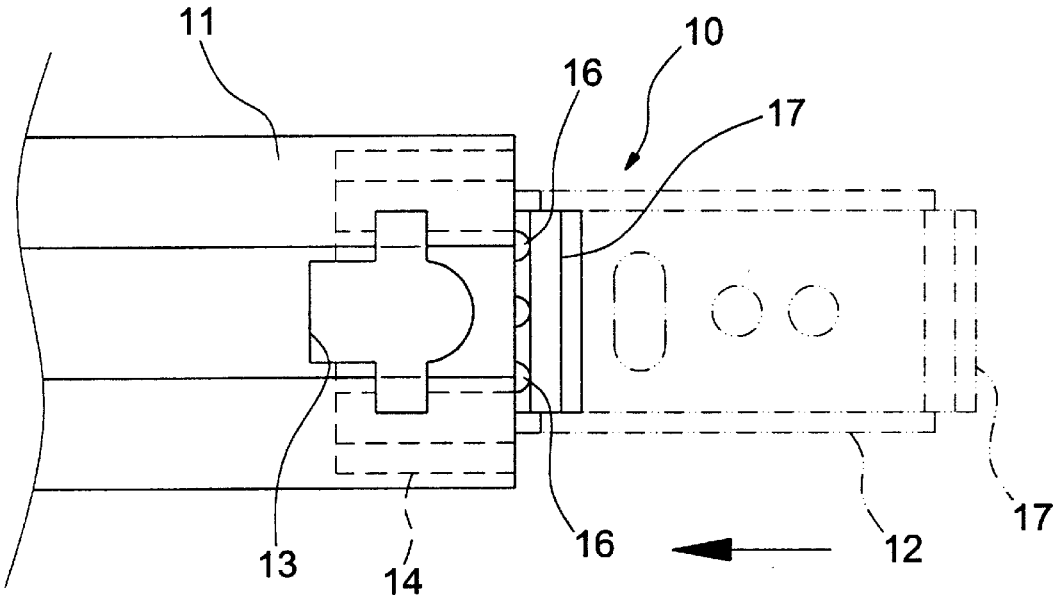
Fig. 6 PRIOR ART
FIG. 6 is a schematic top view of a portion of a conventional track device using the conventional bumping block in FIG. 5.
Figure 7:
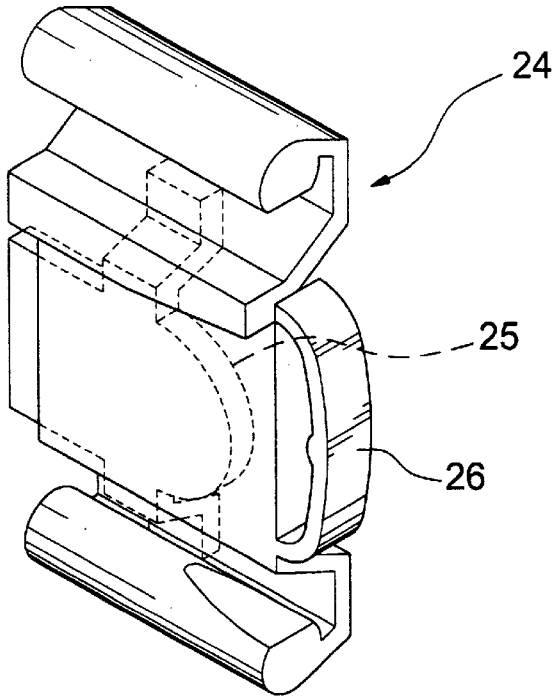
Fig. 7 PRIOR ART
FIG. 7 is a perspective view of another conventional bumping block.
Figure 8:
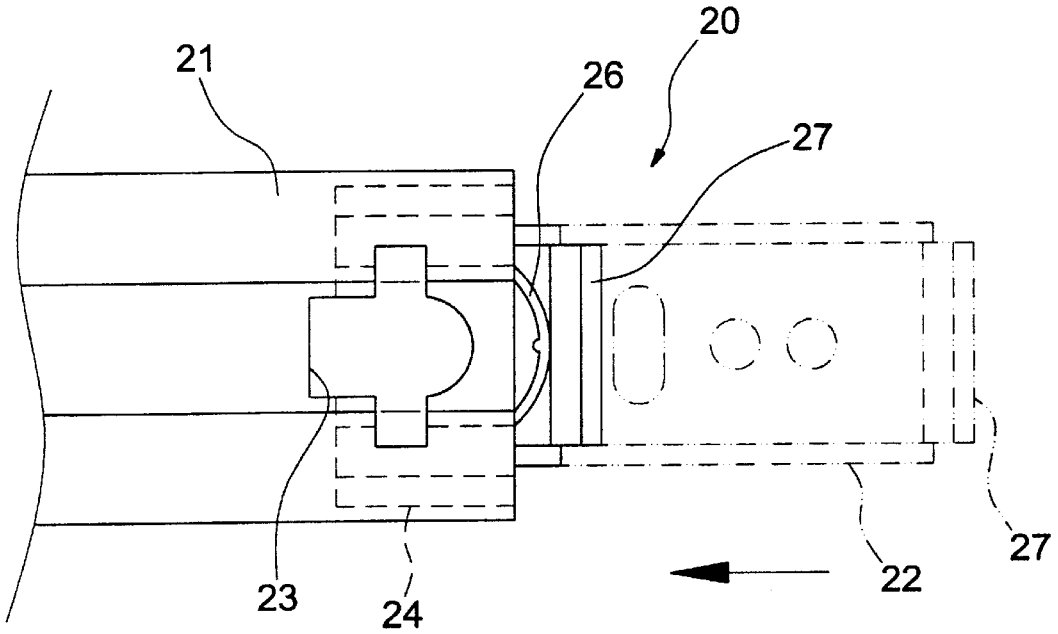
Fig. 8 PRIOR ART
FIG. 8 is a schematic top view of a portion of a conventional track device using the conventional bumping block in FIG. 7.

Referring to FIGS. 1 through 4 and initially to FIGS. 1 and 2, a track device 30 in accordance with the present invention generally includes a pair of fixed tracks 31 (only one of them is shown) respectively mounted to two mutually facing inner wall surfaces of a desk, e.g., a computer desk. Each fixed track 31 has a sliding track 32 mounted therein. A plate (not shown) for supporting, e.g., a computer keyboard has two sliding strips 33 attached to two lateral sides thereof. Each sliding strip 33 is slidably guided in an associated sliding track 32. At least one of the two sliding tracks 34 has a mounting hole 34 for receiving a mounting portion 41 of a bumping block 40. As illustrated in FIGS. 3 and 4, the bumping block 40 includes an arcuate bumping member 42 on an end thereof for impeding a front end 35 of the sliding strip 33. In addition, at least one rib 43 projects from an end face of the end of the bumping block 40 and extends radially outward toward the arcuate bumping member 42. In this embodiment, there are two ribs that present a V-shape and are located inside a space defined between the end face of the bumping block 40 and the arcuate bumping member 42.

By such an arrangement, the front end 35 of the sliding strip 33 is impeded by the arcuate bumping member 42 of the bumping block 40 when the plate for supporting the computer keyboard is moved inward. This prevents shocks to the computer desk when pushing the plate inward to its storage position. The ribs 43 of the bumping block 40 improve the structural strength and prevent breakage of the arcuate bumping member 42.

It is noted that the sliding track 32 can be omitted, the bumping block 40 can be directly mounted to an end of the fixed track 31, and the sliding strip 33 can be slidably engaged in the fixed track 31.

Although the invention has been explained in relation to its preferred embodiment, it is to be understood that many other possible modifications and variations can be made without departing from the scope of the invention as hereinafter claimed.

What is claimed is:

1. A track device for a desk having a plate slidably mounted therein, comprising:

a pair of tracks adapted to be respectively fixed to two mutually facing inner walls of the desk;

a pair of sliding strips adapted to be securely and respectively mounted two lateral sides of the plate, each said sliding strip including an end; and a bumping block mounted to at least one of the tracks and including an end, an arcuate bumping member being provided on the end of the bumping block for impeding the end of an associated said sliding strip, at least one rib projecting from an end face of the end of the bumping block and extending radially outward toward the arcuate bumping member.

2. A track device for a desk having a plate slidably mounted therein, comprising:

a pair of tracks adapted to be respectively fixed to two mutually facing inner walls of the desk;

a pair of sliding strips adapted to be securely and respectively mounted two lateral sides of the plate, each said sliding strip including an end; and a bumping block mounted to each said track and including an end, an arcuate bumping member being provided on the end of the bumping block for impeding the end of an associated said sliding strip, two ribs projecting from an end face of the end of the bumping block and extending radially outward toward the arcuate bumping member, thereby presenting a V-shape configuration.

* * * * *